US006289708B1

(12) United States Patent
Keinänen

(10) Patent No.: US 6,289,708 B1
(45) Date of Patent: Sep. 18, 2001

(54) APPARATUS FOR ROLL FORMING PURLINS AND THE LIKE FROM A METAL STRIP

(75) Inventor: Rauno Keinänen, Nilsiä (FI)

(73) Assignee: Samesor Oy, Kuopio (FI)

( * ) Notice: Subject to any disclaimer, the term of this patent is extended or adjusted under 35 U.S.C. 154(b) by 0 days.

(21) Appl. No.: 09/479,446

(22) Filed: Jan. 7, 2000

Related U.S. Application Data

(63) Continuation of application No. 09/331,069, filed as application No. PCT/IB97/01571 on Dec. 16, 1997.

(30) Foreign Application Priority Data

Dec. 17, 1996 (FI) ..... 965070

(51) Int. Cl.[7] ..... B21D 5/08
(52) U.S. Cl. ..... 72/178; 72/181
(58) Field of Search ..... 72/181, 178, 182

(56) References Cited

U.S. PATENT DOCUMENTS

| | | | | |
|---|---|---|---|---|
| 2,458,906 | | 1/1949 | Himmel et al. . | |
| 2,471,490 | | 5/1949 | Mercer . | |
| 3,462,989 | | 8/1969 | Fischer, Jr. . | |
| 3,914,971 | | 10/1975 | Colbath | 72/178 |
| 4,716,754 | * | 1/1988 | Youngs | 72/181 |
| 4,787,232 | * | 11/1988 | Hayes | 72/181 |
| 5,829,294 | * | 11/1998 | Bradbury | 72/181 |
| 5,983,691 | | 11/1999 | Voth et al. | 72/178 |
| 6,148,654 | | 11/2000 | Jensen et al. | 72/181 |
| 6,216,514 | * | 4/2001 | Bradbury | 72/181 |

FOREIGN PATENT DOCUMENTS

| | | |
|---|---|---|
| B-71186/87 | 10/1987 | (AU) . |
| 1022072A2 | 1/2000 | (EP) . |
| 2188859A | 10/1987 | (GB) . |

OTHER PUBLICATIONS

Rollforming and associated machinery for the Metal Building Components Manufacturing Industry. Datasheets [online]. Hayes International, 19??, [retrieved on Sep. 22, 1997] Retrieved from the Internet: URL="http://www.HAYESINT.COM.AU" URL="http://www.HAYESINT.COM.AU/AboutHayes.html" URL="http://www.HAYESINT.COM.AU/Products.html" URL="http://www.HAYESINT.COM.AU/WhatsNew.html".

The Automated Purlin Rollformer.

Forth, Feb. 1996, Modern Metals, Split–level Roll Former Speeds Changeover, (Reprint).

* cited by examiner

*Primary Examiner*—Daniel C. Crane
(74) *Attorney, Agent, or Firm*—Klauber & Jackson

(57) ABSTRACT

An apparatus for roll forming purlins and the like from a metal strip (37) allows the choice between upwards bending and downwards bending by means of two sets of forming rollers (40, 43) arranged on either side of drive rollers (38, 39, 41, 42) feeding the strip (37). At least one of the two set of forming rollers (40, 43) is vertically adjustable. The apparatus can be applied, for instance, to the forming of steel profiles for construction purposes.

13 Claims, 8 Drawing Sheets

APPARATUS FOR ROLL FORMING PURLINS AND THE LIKE FROM A METAL STRIP

This application is a continuation of application Ser. No. 09/331,069, filed Jun. 16, 1999, which is a 371 of PCT/IB97/01571, filed Dec. 16, 1997.

TECHNICAL FIELD

The present invention relates to an apparatus for roll forming purlins and the like from a metal strip. The invention can be implemented in the forming of purlin profiles of various sizes and material thicknesses in the same roll forming machine.

In purlins and similar products used in construction and industry, bendings are usually 90° basic bendings, but other bending angles are also applicable. Purlins with a U, C or Z profile are commonly used as steel construction elements.

BACKGROUND ART

Prior art will be described below with reference to the accompanying drawings, in which:

FIG. 1 is a top plan view of a conventional prior-art apparatus for roll forming purlins from a metal strip, FIG. 2 is a side view of a part of a prior-art roll forming apparatus, FIG. 3 is a cross-section of a purlin formed in the prior-art roll forming apparatus of FIG. 2, FIG. 4 shows how C or U purlins are being formed in a prior-art arrangement, and FIG. 5 shows how Z purlins are being formed in the prior-art arrangement of FIG. 4.

FIG. 1 illustrates a known apparatus for roll forming purlins from a metal strip 1 of thin metal sheet. The metal strip 1 enters the roll former from the left (arrow A), and a purlin 1' formed from the strip 1 leaves the roll former to the right. The forming of the strip 1 in the roll former is illustrated by three cross-sections marked with braces in FIG. 1. In this case, the roll former comprises two sets of rollers, the first set 2 bending the two outermost edges of the purlin 1' to 90° (=the outermost corners inwards by 90°).

After this, the second set of rollers 3 of the roll former bends the innermost sides of the purlin 1' to 90° (=the innermost corners inwards by 90°). The finished U or C profiled purlin 1' will leave the roll former to the right.

FIG. 2 shows the design of sets of freely rotatable or idling rollers in a prior-art roll former, and FIG. 3 shows the cross-section of the purlin 1'. In FIG. 2, the set of rollers of the roll former comprises rollers 5–12 rotatably mounted on a frame 4. The operation of the roll former is based on the fact that, as the horizontal and schematically shown metal strip 1 is fed into the set of rollers 5–12 from the left, it will first reach the roller 5, which makes the first bending of the strip 1. Subsequently, the strip 1 reaches the following roller 6, which in turn bends the strip 1 slightly more. Each following roller 7–11 in the set of rollers will bend the strip 1 slightly more, until the final roller 12 bends the strip 1 in a desired final 90° angle (cf. FIG. 3).

There are a number of previously known roll forming machines for manufacturing U or C purlins. There are also various known roll forming machines for Z purlins. In this case, the bendings in the roll forming line must be feasible not only upwards but also downwards. FIGS. 9A–9E of U.S. Pat. No. 4,716,754 to Youngs, for instance, illustrate a known solution for forming Z purlins. As to the background art, U.S. Pat. No. 4,787,232 to Hayes should also be mentioned, which discloses a roll former for the manufacture of purlins of various profiles.

The degree of difficulty is increased by the fact that U, C and also Z purlins need to be manufactured in the same roll forming line. Commonly available solutions to this problem have been based on changing of the individual rollers or frame members, such as rafts or cassettes, on which the sets of rollers are already mounted. Such changes are laborious and require skilful operators, and special lifting equipment is needed.

FIG. 4 shows a prior-art roll forming arrangement as C or U purlins are being formed. This known arrangement comprises a left-hand and a right-hand roll forming block 13, 17, respectively, drive rollers 14, 18 and sets of rotatable rollers 15, 16, 19. The illustrated prior-art solution can be used to form the metal strip 20 into C or U purlins in the normal state.

FIG. 5 illustrates the prior-art roll forming arrangement of FIG. 4 as Z purlins are being formed. When Z purlins are being formed, the left-hand roll forming block 13 has been lifted vertically upwards (arrow B) relative to the right-hand roll forming block 17 which normally is stationary. The metal strip 21 to be formed will now be differently positioned relative to the drive rollers 14, 18 and to the rotatable rollers 15, 19. In addition, lifting the entire forming block 17 will require separate, complex and heavy-duty lifting equipment. The illustrated prior-art solution will form Z purlins in this state.

The prior-art solution illustrated in FIGS. 4–5 has the drawback of a complex design, involving up to three shafts. On top of that, the lifting of the entire forming block 13 is extremely awkward.

The arrangement shown in FIGS. 4–5 is described in an article by Karl D. Forth entitled "Split-level roll former speeds changeover" issued in February 1996. These known roll formers are marketed by the US company Bradbury Co.

In a further known solution, the pair of rollers turns 180° about its forming centre. The rotating shafts require high accuracy of manufacture and advanced equipment, by means of which the rotation is controlled and blocked (cf. U.S. Pat. No. 4,787,232 to Hayes).

SUMMARY OF THE INVENTION

The purpose of the present invention is to provide an improved apparatus for roll forming purlins or the like from a metal strip, which enables the problems above to be resolved and the drawbacks to be eliminated. This is achieved by an apparatus according to the invention, which has the features of appended claim 1, preferred embodiments being defined in the subclaims.

The improved apparatus of the invention has several advantages. Thanks to the new and unique arrangement of the rollers, and the structure and adjustment of the same, a very effective manufacture of purlins can be accomplished. The movement of the strip bending rollers is achieved in a simple but ingenious way.

The roll forming apparatus of the invention has the advantage of being operational and of having a straightforward design. In addition, by the invention, the bending is performed with such rollers that tend to reduce friction during forming. The invention involves simple adjustment of the material thickness both in the horizontal and in the vertical direction.

In accordance with the invention, roll forming and prepunching of purlins can take place in the same integrated line, and bendings of various sizes and in various directions (upwards and downwards bending) are automatically performed.

A preferred embodiment involves the further advantage of performing the forming with idle rollers, so that there will not be high friction caused by difference of speed against the metal strip to be formed.

BRIEF DESCRIPTION OF THE DRAWINGS

The invention will be described in greater detail below with reference to the accompanying schematic drawings, which, by way of example, illustrate preferred embodiments and in which.

DETAILED DESCRIPTION OF PREFERRED EMBODIMENTS

FIGS. 1–5 have been explained above. The invention will be described below with reference to FIGS. 6–10 illustrating the first embodiment of the invention.

Figure 1:
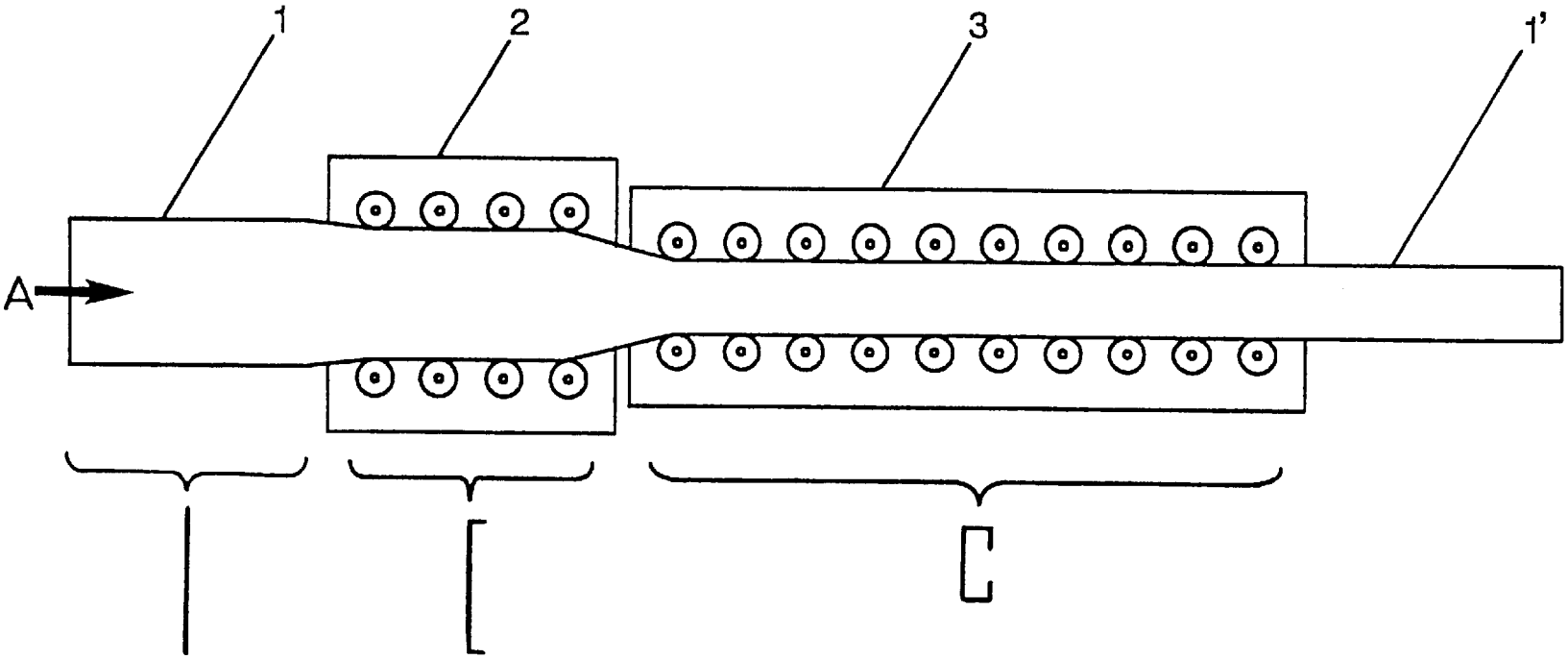
FIG.1 PRIOR ART
FIG. 1 shows from above a prior-art apparatus for roll forming purlins from a metal strip.
Figure 2:
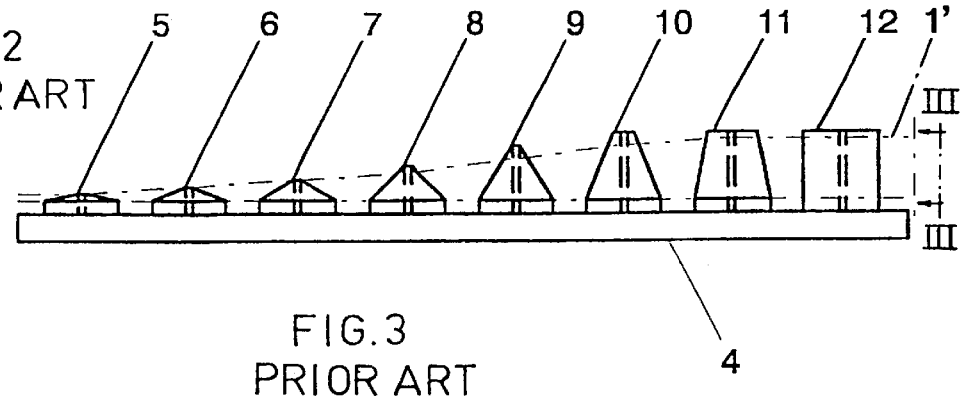
FIG. 2 PRIOR ART
FIG. 2 shows a part of a prior-art roll forming apparatus from the side.
Figure 3:
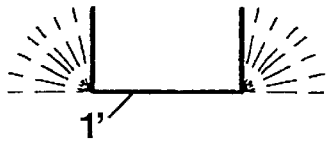
FIG. 3 PRIOR ART
FIG. 3 shows a cross-section of a purlin formed in the prior-art roll forming apparatus of FIG. 2.
Figure 4:
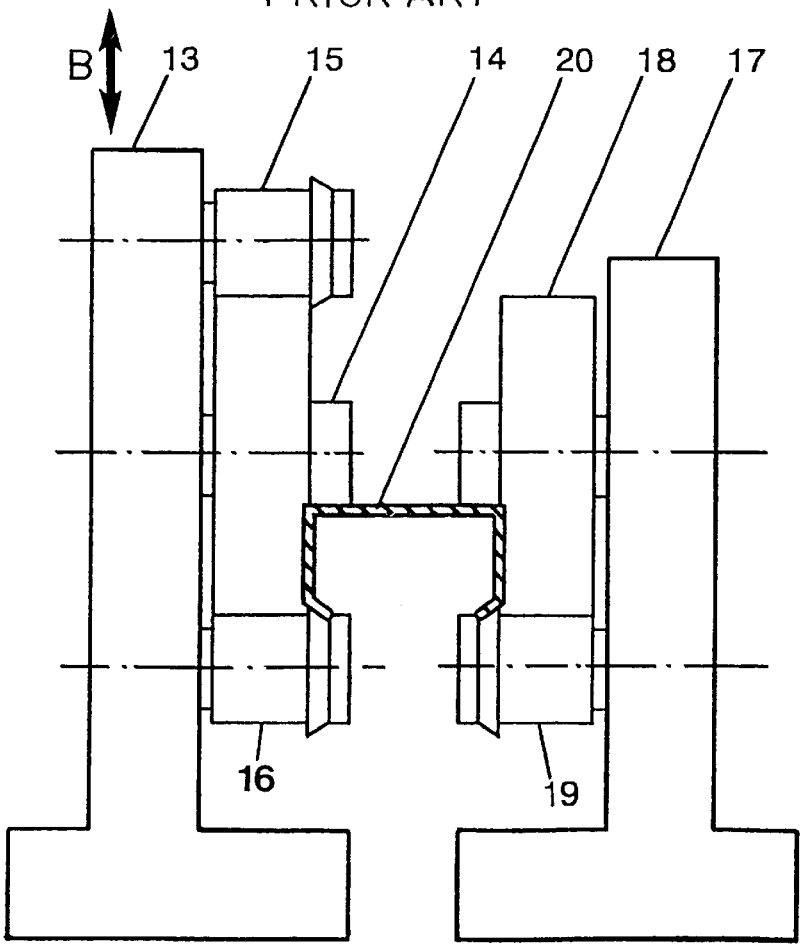
FIG. 4 PRIOR ART
FIG. 4 shows how C or U purlins are being formed in a prior-art arrangement.
Figure 5:
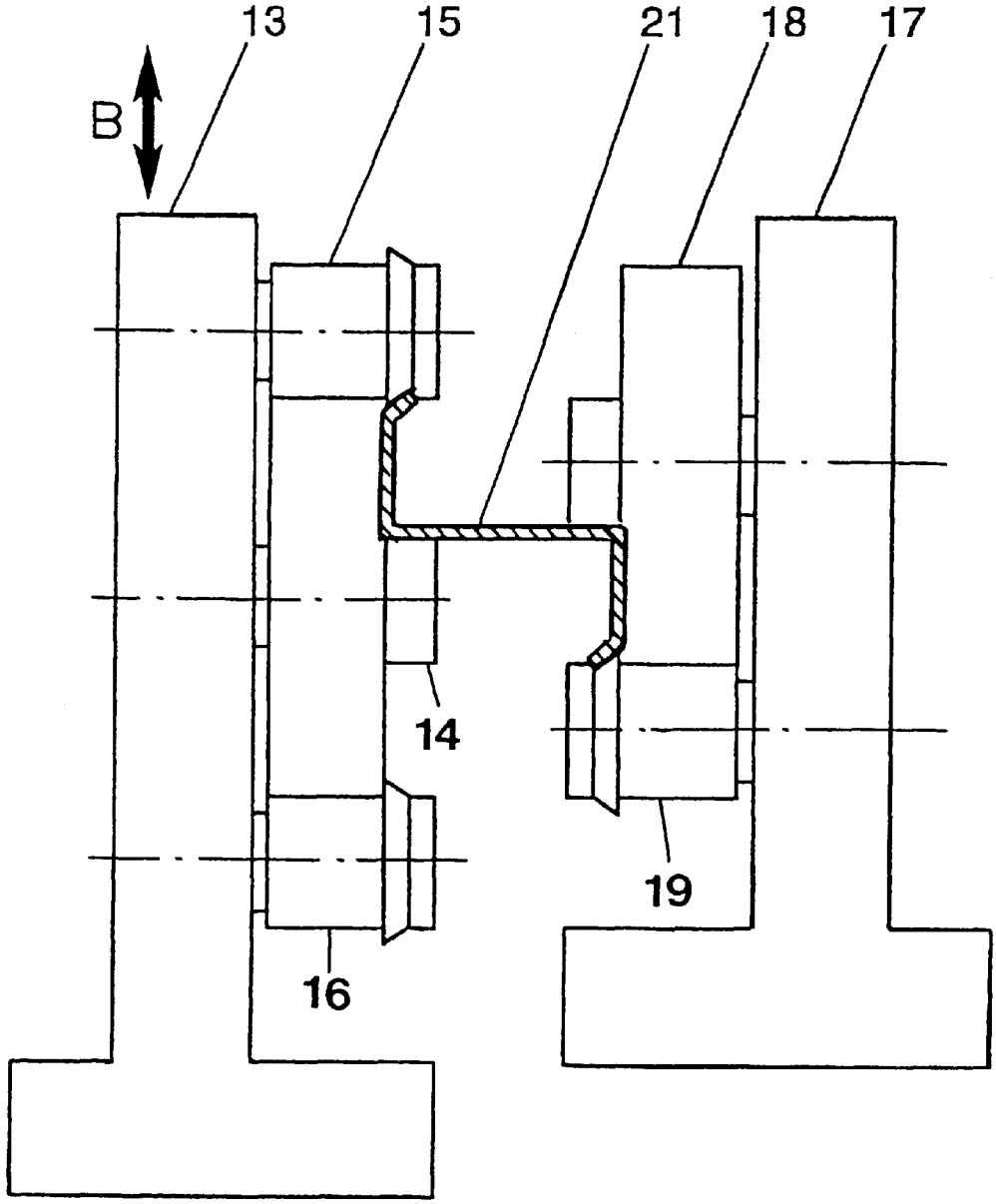
FIG. 5 PRIOR ART
FIG. 5 shows how Z purlins are being formed in the prior-art arrangement of FIG. 4.
Figure 6:
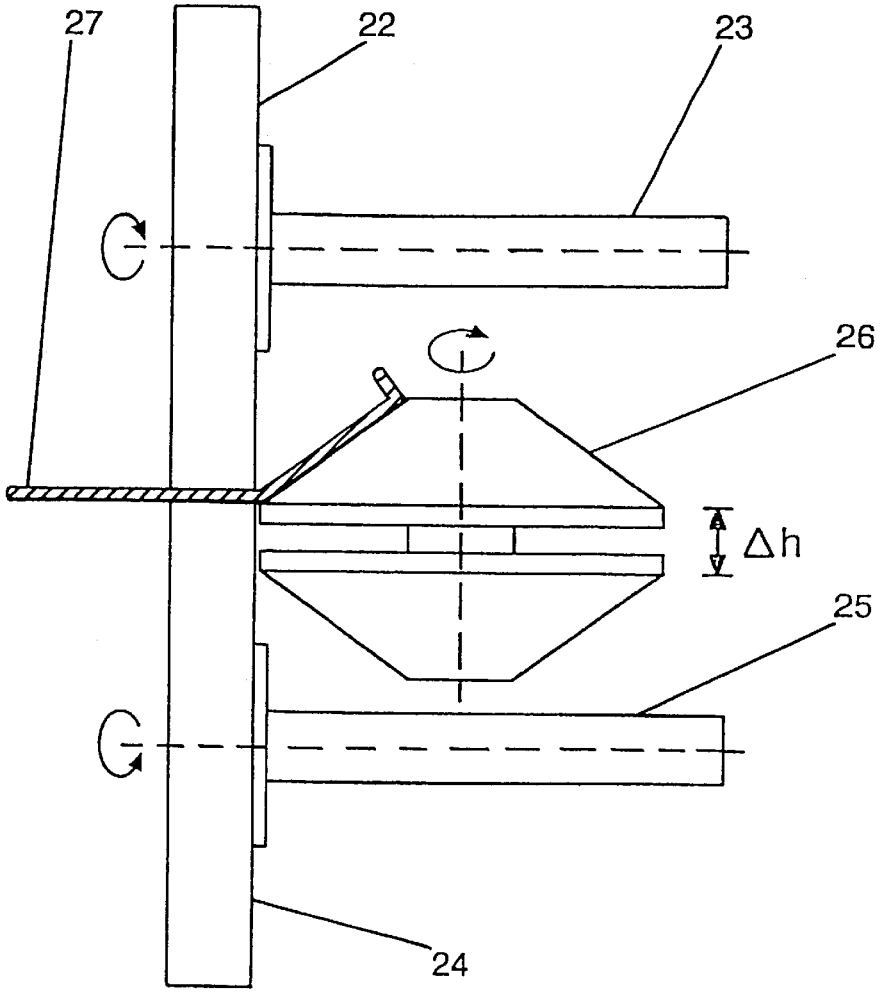
FIG. 6 shows the structure of an individual roller in a roll forming apparatus according to a first embodiment of the invention.

FIG. 6 shows the functional structure of the roll forming apparatus of the invention, which comprises an upper drive roller 22, which is attached to a driving upper shaft 23, and a lower drive roller 24, respectively, which is attached to a driving lower shaft 25. The drive rollers 22, 24 are referred to as main rollers, between which a strip 27 of thin metal sheet is clamped and fed along the roll former.

In addition, the roll forming apparatus comprises a symmetrically shaped set of forming rollers including freely rotatable or idle rollers 26 which bend or form the strip 27. The forming roller 26 has an upper frustoconical part and a lower frustoconical part, and the inclined, circumferential surfaces of these parts bend the strip 37. The two parts are spaced apart and are connected by a rod. By shifting the entire set of rollers slightly upwards or downwards, one may choose whether a U or C profile purlin or alternatively a Z profile purlin is produced.

Figure 7:
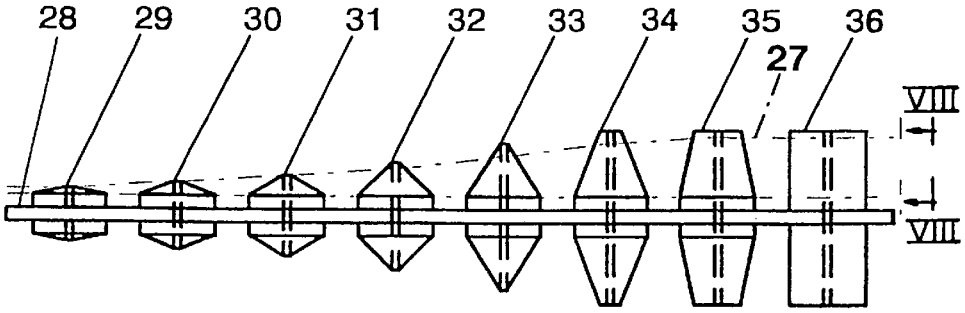
FIG. 7 shows from the side an assembly of the freely rotatable rollers in a roll forming apparatus according to the first embodiment.
Figure 8:
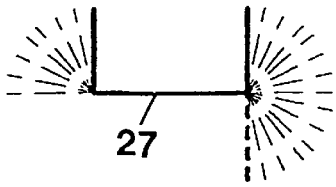
FIG. 8 shows a cross-section of a purlin formed in the roller assembly of FIG. 7.

FIG. 7 shows the design of the idling sets of forming rollers of the roll former of the invention. In the Figure, a set of rollers, which are rotatably mounted on a central frame 28, comprises rollers 29–36. These rollers 29–36 are disposed symmetrically on both sides of the frame 28. By shifting the entire frame 28 including the rollers 29–36 slightly upwards or downwards, one may choose whether a U or a C profile purlin or alternatively a Z profile purlin is produced.

The operation of the inventive roll former is based on the fact that, as the horizontal metal strip 27 (schematically shown in FIG. 7) is fed into the set of rollers 29–36 from the left, it will first reach the roller 29, which bends the strip 27 slightly. The bending direction of the strip 27 depends on whether the set of rollers 29–36 is in the upper position or the lower position. Subsequently, the metal strip 27 reaches the following roller 30, which in turn bends the strip 27 slightly more. Each further roller 31–35 in the set of rollers will bend the metal strip slightly more, until the final roller 36 in the set of rollers bends the strip 27 in a 90° angle (cf. FIG. 8).

Figure 9:
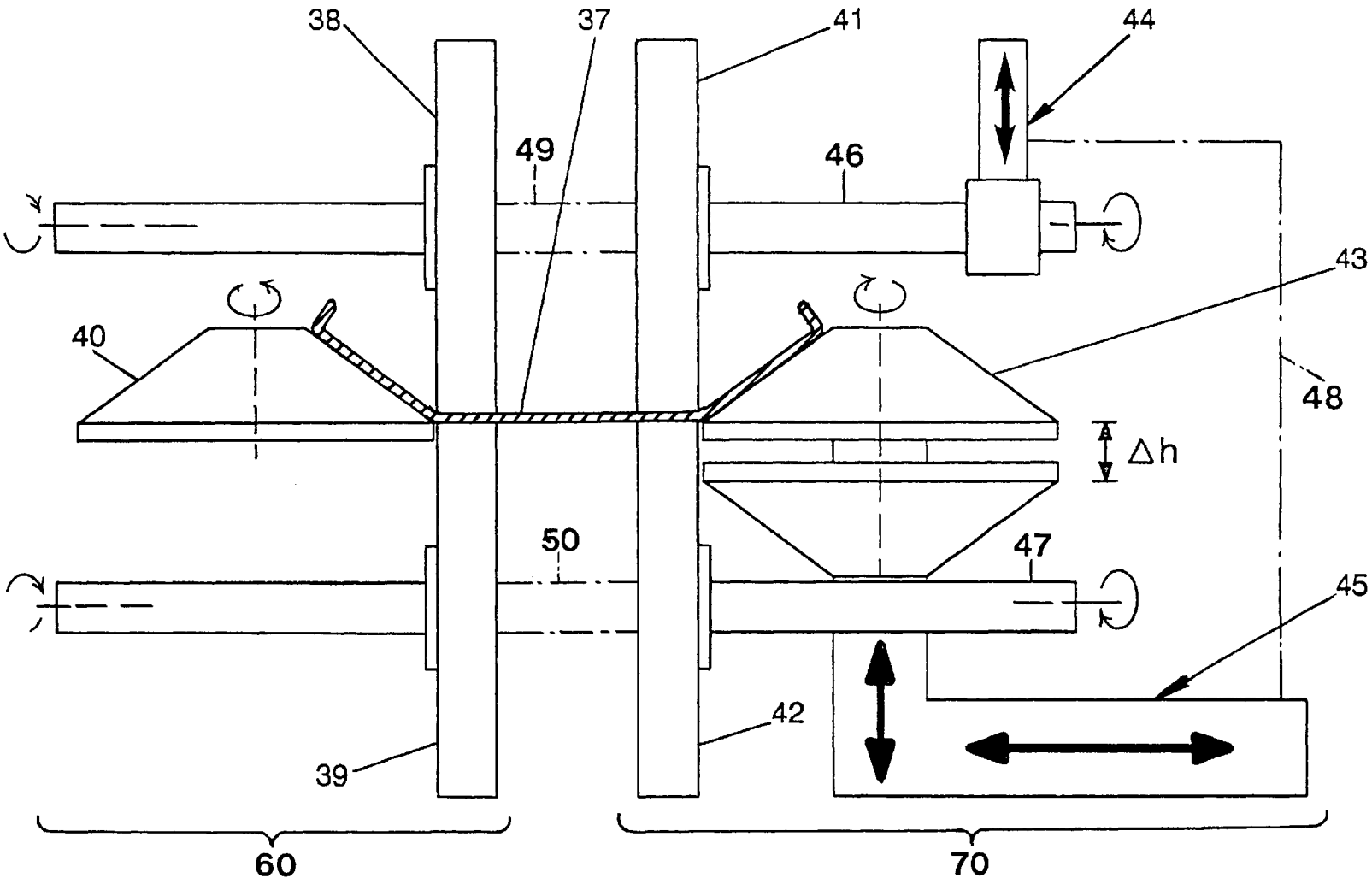
FIG. 9 shows how a U purlin is being formed in the apparatus of the first embodiment.

FIG. 9 illustrates a part of the roll former of the invention as U purlins are being formed. In the Figure, the metal strip to be formed has the reference 37. The roll former comprises a first or left-hand frame element 60 including an upper drive roller 38 and a lower drive roller 39, and also a set of idle strip forming rollers 40. In addition, the roll former comprises a second or right-hand frame element 70 including an upper drive roller 41 and a lower drive roller 42, and also a set of idle rollers 43 for bending the strip 37. The drive rollers 38, 39, 41, 42 are referred to as main rollers for clamping and feeding the strip 37. The roll former also comprises sets of adjusting means, each including an upper member 44 connected to the shaft 46 of the upper drive roller 41, and a lower member 45 adjacent to the shaft 47 of the lower drive roller 42. As is schematically shown at 48 and as will be further described below, the adjustment members 44 and 45 are mechanically interconnected.

The rollers 38, 41 and 39, 42, respectively, can be mechanically connected, as is schematically shown at 49 and 50. This connection is, however, optional.

Figure 10:
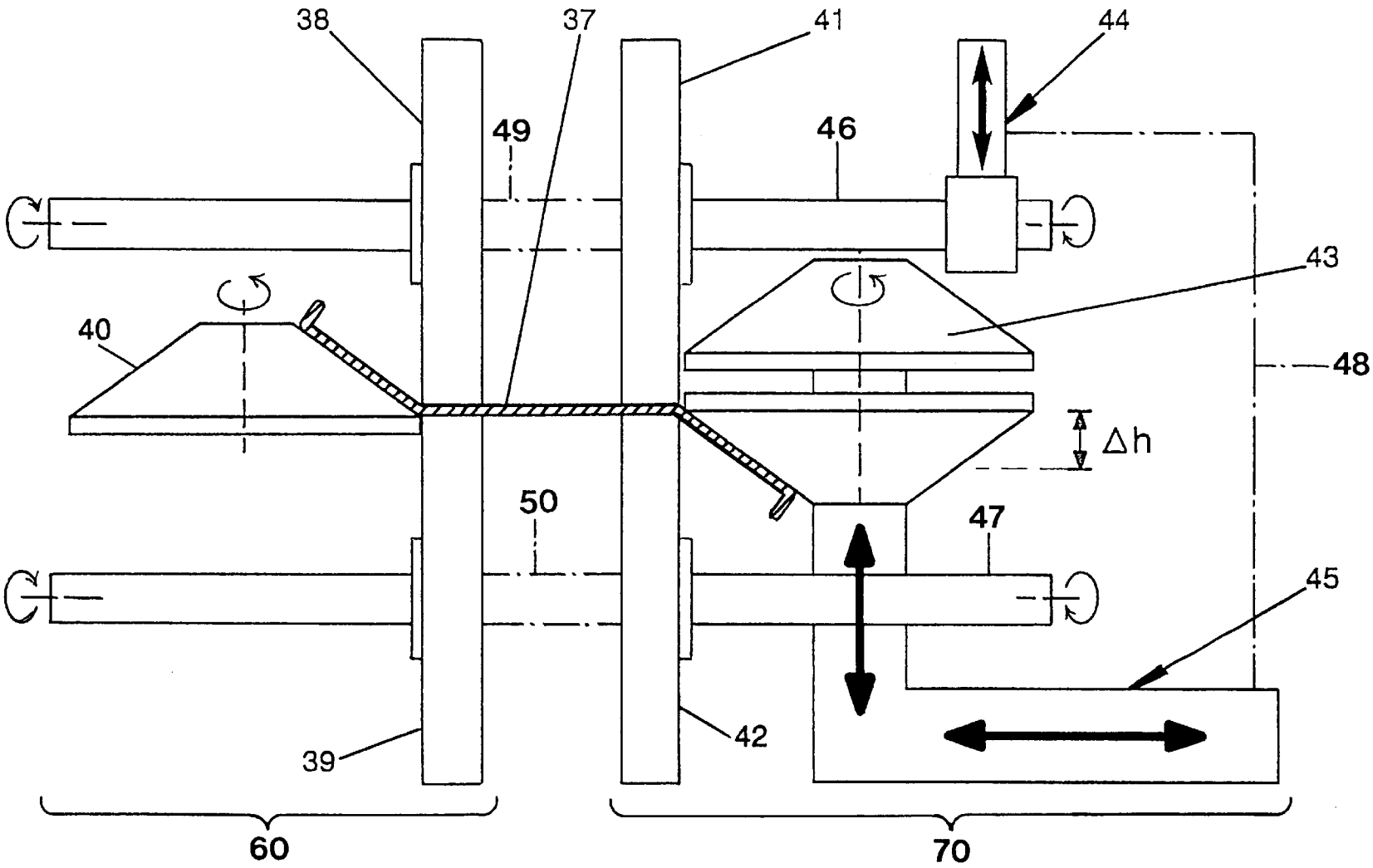
FIG. 10 shows how a Z purlin is being formed in the apparatus of the first embodiment.

FIG. 10 shows a part of the roll former of the invention as Z purlins are being formed. References 37–50 in FIG. 10 are the same as in FIG. 9. In FIG. 10, the set of so-called side rollers 43 has been displaced over a distance $\Delta h$ into a second upper position, whereby one edge portion of the metal strip 37 is bent downwards and a Z profile is provided. The displacement is very small, and it is performed, for instance, by means of a hydraulic system known per se (not shown).

By means of the invention, the choice between upwards bending and downwards bending is made by lifting or lowering, in the vertical plane, the bending, idling rollers 26, 29 to 36, 43 with the aid of the adjusting means 44, 45. The main rollers 22, 24, 38, 39, 41, 42 feed the metal strip 27, 37. The idling rollers 26, 29 to 36, 43 perform the actual bending together with the driving main rollers 22, 24, 38, 39, 41, 42. The gap or nip between the main rollers 22, 24, 38, 39, 41, 42 is varied depending on the material thickness by lifting or lowering the upper shaft 23, 46 with the aid of the adjusting member 44. The side rollers 43 can be adjusted according to the material thickness by moving these rollers with the aid of the adjusting member 45.

Figure 11:
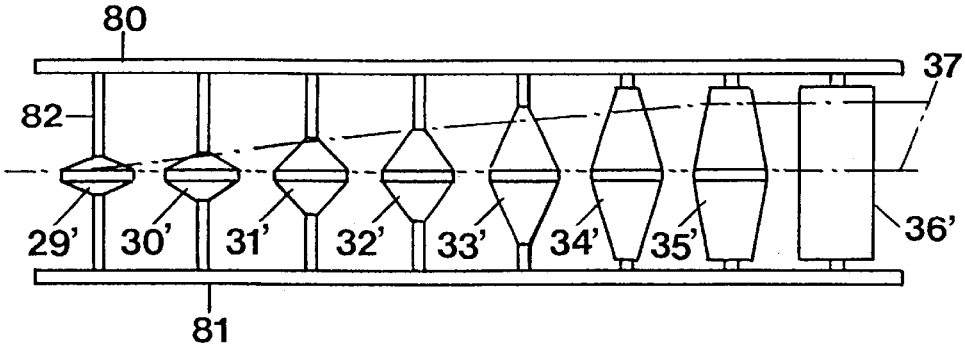
FIG. 11 shows from the side an assembly of the freely rotatable rollers in a roll forming apparatus according to a second embodiment of the invention.
Figure 12:
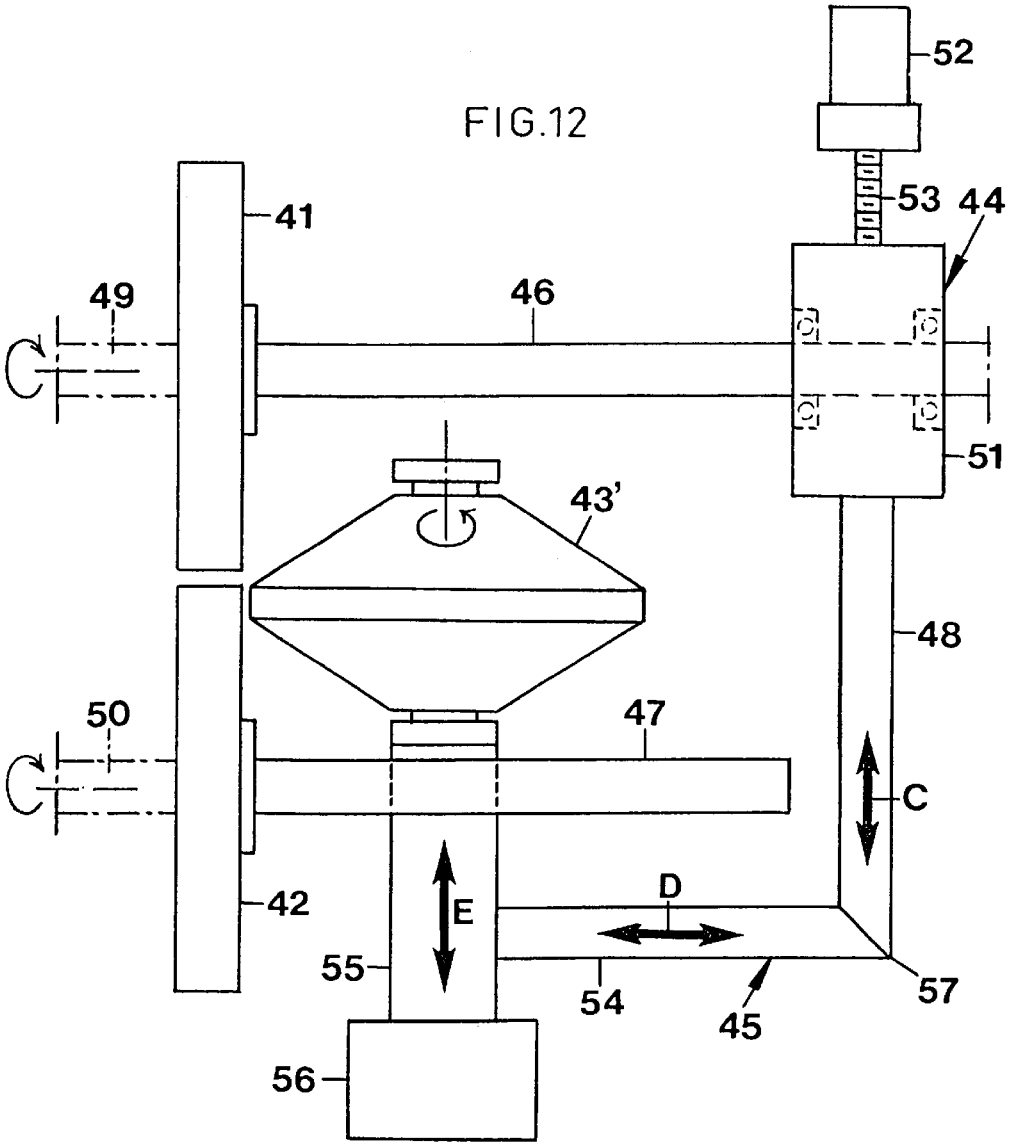
FIG. 12 shows a modified roller and its means for adjustment according to the second embodiment.

A second, presently preferred, embodiment of the apparatus of the invention is shown in FIGS. 11–12. FIG. 11 corresponds to FIG. 7 and shows two spaced-apart frame members 80, 81 having a number of rods 82, on which idle strip bending rollers 29'–36' are rotatably mounted. These rollers 29'–36' correspond to the rollers 29–36 of FIG. 7, but in this embodiment, the two parts of the rollers 29'–36' are not spaced apart. Instead, the two parts of each roller 26'–36' are directly connected to each other. Preferably, each roller 29'–36' is a one-piece component, which reduces the cost of the same and makes the mounting in the frame 51, 52 simpler.

The forming of the metal strip 37 is performed in the same way in the apparatus shown in FIG. 11 as in FIG. 7. The profile of the resulting purlin is the same in both cases (cf. FIG. 8).

FIG. 12 corresponds to FIGS. 9–10 and shows more in detail a modified strip forming roller 43' as well as the mechanical connection between the upper adjustment member 44 and the lower adjustment member 45. The upper adjustment member 44 comprises a bearing box 51 mounted on the upper shaft 46, and a power unit 52 connected to the bearing box 51 by a rod or the like, in this embodiment a guide screw 53. A vertical connecting rod 48 is coupled between the bearing box 51 and the lower adjustment means 45 which comprises a horizontal rod 54 connected to a member 55 supporting the rotatable forming roller 43'. The supporting member 55, and thus the forming roller 43', is vertically adjustable by means of a power unit 56 which is schematically shown. The connection between the vertical rod 48 and the horizontal rod 54, at the "corner" 57, comprises two inclined cam surfaces.

For adjustment, the upper power unit 52 is activated and moves the upper shaft 46 via the screw 53 and the bearing box 51. At the same time, the vertical rod 48 is vertically moved (arrow C), which in turn moves the horizontal rod 54 horizontally (arrow D) due to the cam surfaces at the corner 57. By this movement, and by vertical movement caused by the lower power unit 56, the supporting member 55 and thereby the forming roller are moved (arrow E) in accordance with the desired bending of the strip (which is not shown in FIG. 12). In practice, very good results have been achieved by this adjustment system.

Figure 13:
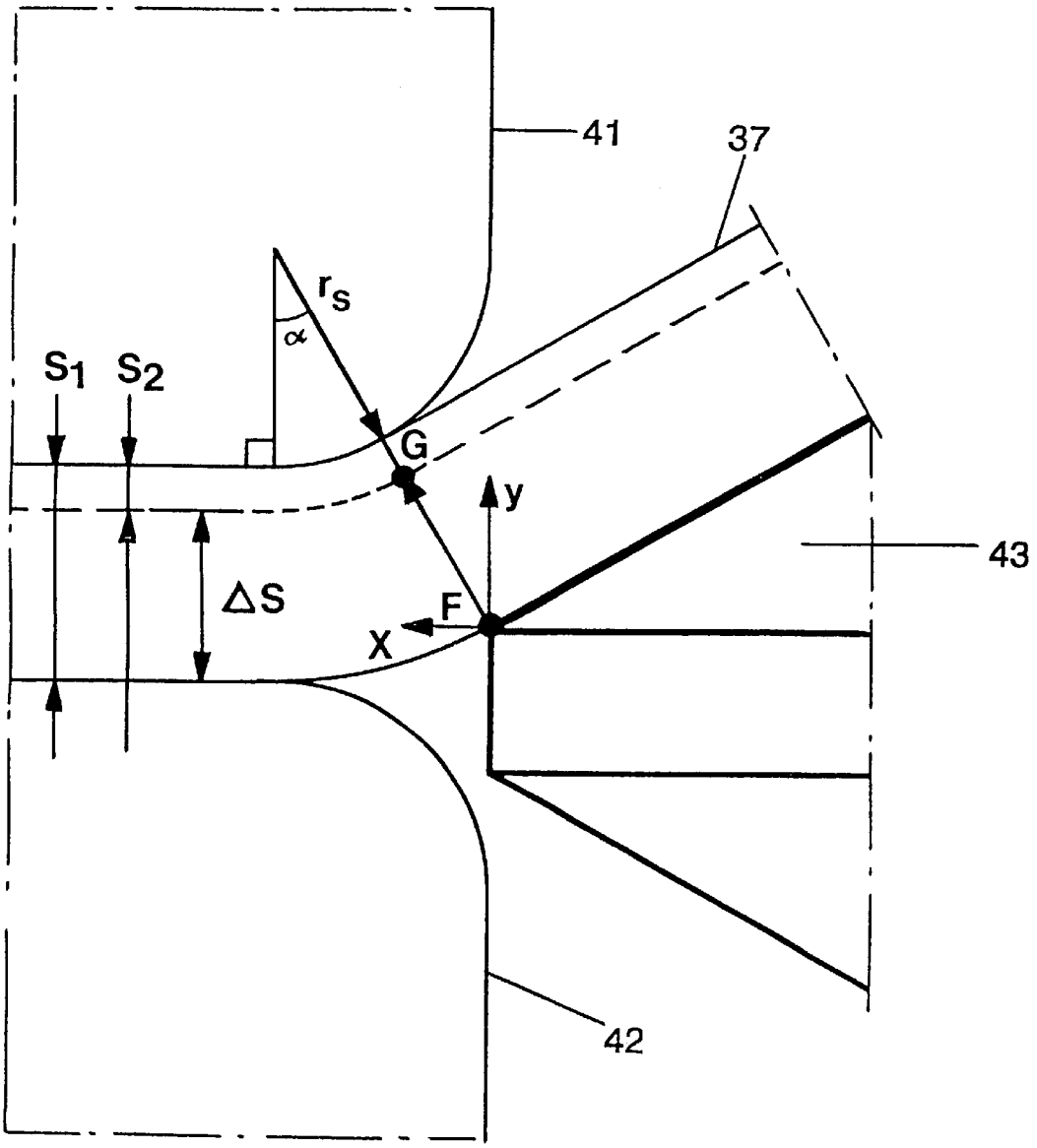
FIG. 13 shows, on a larger scale, adjustment of the roll forming apparatus of the invention according to the thickness of the metal strip to be formed.

FIG. 13 illustrates a preferred adjustment of the roll forming apparatus of the invention according to the thickness of the metal strip to be formed. FIG. 13 shows the strip 37, the upper drive roller 41 and the lower drive roller 42, and also an idle side roller 43. During the bending process, the strip 37 bends around the upper drive roller 41, and the bent strip 37 will have an inner radius $r_s$ depending on the rounding of the upper drive roller 41, regardless of the thickness of the strip 37. Accordingly, the outer radius of the bent strip 37 will be the sum of the inner radius and the thickness of the strip 37, $r_s+s_2$ in FIG. 13.

According to one aspect of the invention, the gap between the main rollers 22, 24, 38, 39, 41, 42 is varied according to the material thickness of the metal strip 37 by lifting or lowering the upper shaft 23 with the aid of the adjusting member 44. In FIG. 13, the strip 37 having a thickness $s_1$ is being formed. When the manufacture switches from a strip 37 with a thickness $s_1$ to a thinner strip 37 with a thickness $s_2$, the upper drive roller 41 is lowered by means of the adjusting member 44 over a distance $\Delta s=s_1-s_2$. Accordingly, when the manufacture switches from a strip 37 with a thickness $s_2$ to a thicker strip 37 with a thickness $s_1$, the upper drive roller 41 is lifted with the aid of the adjustment member 44 upwards over a distance $\Delta s=s_1-s_2$.

The overall adjustment of the side rollers 43 is performed by moving these rollers 43 by means of the adjusting member 45. When the idle side roller 43 is shifted from a first operating point F to a second operating point G of the thinner strip 37, the side roller 43 has to be transferred horizontally over a distance $x=\sin\alpha\cdot\Delta s$, depending on a bending angle $\alpha$. Accordingly, in the vertical direction, the displacement of the side roller 43 relative to the upper drive roller 41 is $y=\cos\alpha\cdot\Delta s$. Since the upper drive roller 41 is lowered, the factual adjustment of the side roller 43 in the horizontal direction is $y=(1-\cos\alpha)\cdot\Delta s$. When the set of side rollers 43 is being moved with the aid of the adjusting member 45, the changes of the bending angle $\alpha$ are taken into account at various points along the forming line.

The bendings performed by the roll former of the invention are usually 90° basic bendings, but other bending angles are also feasible. The apparatus of the invention can be used for manufacturing, for instance, steel construction purlins. Beside the applications above, the shifting from upward bending to downward bending in accordance with the invention can be applied to several profiles of other types, including also more complex profiles than described herein.

In a modification, the forming rollers may be individually adjustable in the vertical and in several positions between the two operating points mentioned above. Preferably, the forming rollers are idle, but in specific applications some of them may be driven as well.

What is claimed is:

1. An apparatus for roll forming purlins from a metal strip (27, 37) comprising:

a left-side frame element (60) having an upper drive roller (38) and a lower drive roller (39), and a set of strip forming rollers (40), a right-side frame element (70) having an upper drive roller (22, 41) and a lower drive roller (24, 42) and a set of strip forming rollers (26, 29–36, 43; 43'), and sets of adjusting means (44, 45) such that the choice between upward bending and downward bending of the strip (27, 37) is made by lifting or lowering movements of the forming rollers (26, 29–36, 43; 43') vertically and in the direction of the rotational axis of said forming rollers, the drive rollers (22, 24, 38, 39, 41, 42) clamping and feeding the metal strip (27, 37), and the forming rollers (26, 29–36, 43; 43') performing the actual bending together with the drive rollers (22, 24, 38, 39, 41, 42).

2. An apparatus as claimed in claim 1, wherein the forming rollers (26, 29–36, 43; 43') are lifted or lowered vertically by means of said adjusting means (44, 45).

3. An apparatus as claimed in claim 1 or 2, wherein the forming rollers (26, 29–36, 43; 43') are idle rollers.

4. An apparatus as claimed in claim 1 or 2, wherein the gap between the drive rollers (22, 24, 38, 39, 41, 42) is varied depending on the material thickness of the strip (27, 37) by lifting or lowering an upper shaft (23), which supports a drive roller (22), with the aid of said adjusting means (44, 45).

5. An apparatus as claimed in claim 4, wherein, when the manufacture switches from a metal strip (27, 37) having a thickness ($s_1$) to a thinner metal strip (27, 37) having a thickness ($s_2$), the upper drive roller (41) is lowered by means of the adjusting means (44, 45) downwards over a distance $\Delta s=s_1-s_2$.

6. An apparatus as claimed in claim 4, wherein, when the manufacture switches from a metal strip (27, 37) having a thickness ($s_2$) to a thicker metal strip (27, 37) having a thickness ($s_1$), the upper drive roller (41) is lifted with the aid of said adjusting means (44, 45) upwards over a distance $\Delta s = s_{1-s2}$.

7. An apparatus as claimed in claim 1, wherein the forming rollers (43) are adjusted in accordance with the material thickness of the strip (27, 37) by moving the set of forming rollers (43) with the aid of said adjusting means (44, 45).

8. An apparatus as claimed in claim 7, wherein, when each forming roller (43) is adjusted from a first operating point (F) to a second operating point (G) of the thinner strip (27), the bending roller (43) is shifted horizontally $x = \sin\alpha \cdot \Delta s$ and vertically $y = (1 - \cos\alpha) \cdot \Delta s$.

9. An apparatus as claimed in claim 7 or 8, wherein, when the set of forming rollers (43) is being moved, the changes of bending angle ($\alpha$) are taken into account at various points along the forming line.

10. An apparatus as claimed in claim 1, wherein the apparatus is used to manufacture steel construction purlins.

11. An apparatus as claimed in claim 3, wherein the gap between the drive rollers (22, 24, 38, 39, 41, 42) is varied depending on the material thickness of the strip (27, 37) by lifting or lowering an upper shaft (23), which supports a drive roller (22), with the aid of said adjusting means (44, 45).

12. An apparatus as claimed in claim 11, wherein, when the manufacture switches from a metal strip (27, 37) having a thickness ($s_1$) to a thinner metal strip (27, 37) having a thickness ($s_2$), the upper drive roller (41) is lowered by means of the adjusting means (44, 45) downwards over a distance $\nabla s = s_1 - s_2$.

13. An apparatus as claimed in claim 3, wherein, when the manufacture switches from a metal strip (27, 37) having a thickness ($s_2$) to a thicker metal strip (27, 37) having a thickness ($s_1$), the upper drive roller (41) is lifted with the aid of said adjusting means (44, 45) upwards over a distance $\nabla s = s_1 - s_2$.

* * * * *